US006652618B1

(12) United States Patent
Unami et al.

(10) Patent No.: US 6,652,618 B1
(45) Date of Patent: Nov. 25, 2003

(54) IRON BASED MIXED POWER HIGH STRENGTH SINTERED PARTS

(75) Inventors: Shigeru Unami, Chiba (JP); Satoshi Uenosono, Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 10/129,737

(22) PCT Filed: Sep. 12, 2000

(86) PCT No.: PCT/JP00/06225

§ 371 (c)(1),
(2), (4) Date: May 10, 2002

(87) PCT Pub. No.: WO02/22903

PCT Pub. Date: Mar. 21, 2002

(51) Int. Cl.[7] ..... B22F 1/00
(52) U.S. Cl. ..... 75/252; 75/243; 75/246
(58) Field of Search ..... 75/243, 246, 252

(56) References Cited

U.S. PATENT DOCUMENTS 4,069,044 A * 1/1978 Mocarski et al. ..... 75/243
5,256,184 A * 10/1993 Kosco et al. ..... 75/246
5,567,890 A * 10/1996 Lindberg et al. ..... 75/243
5,682,588 A * 10/1997 Tsutsui et al. ..... 419/11
5,703,304 A * 12/1997 Lindberg et al. ..... 75/243
6,332,904 B1 * 12/2001 Fujiki et al. ..... 75/243
6,355,208 B1 * 3/2002 Unami et al. ..... 419/11

FOREIGN PATENT DOCUMENTS

| | | |
|---|---|---|
| JP | B2 58-10962 | 2/1983 |
| JP | A 1-215904 | 8/1989 |
| JP | A 6-510331 | 11/1994 |
| JP | A 9-87794 | 3/1997 |

OTHER PUBLICATIONS

Patent Abstract of Japan, Publication No. 09–310159, Dec. 1997.*

* cited by examiner

*Primary Examiner*—Ngoclan Mai
(74) *Attorney, Agent, or Firm*—Oliff & Berridge

(57) ABSTRACT

On the basis of mass percentage of a mixture, 1–5% of Ni powder, 0.5–3% of Cu powder, and 0.2–0.9% of graphite powder are mixed into an alloy steel powder containing 0.5–3 mass % of prealloyed Ni, more than 0.7 to 4 mass % of prealloyed Mo, and the balance being Fe and unavoidable impurities. The alloy steel powder may contain 0.2–0.7 mass % of prealloyed Cu in addition to Ni and Mo.

5 Claims, No Drawings

IRON BASED MIXED POWER HIGH STRENGTH SINTERED PARTS

TECHNICAL FIELD

The present invention relates to iron-based mixed powders for powder metallurgy, and particularly to an iron-based mixed powder used for manufacturing high strength sintered parts for automobiles.

BACKGROUND ART

In powder metallurgy, a metal powder is compacted by pressing and then sintered to form a sintered body. Since mechanical parts having a complicated shape can be precisely manufactured, powder metallurgy is widely used for manufacturing automobile parts such as gears, which are required to have high dimensional precision. When an iron powder is used as a metal powder, the iron powder is mixed with a Cu powder, a graphite powder, and so on, and the mixture is compacted, and then sintered to form a sintered body having a density of about 5.0–7.2 g/cm$^3$.

The automobile parts are required to have high strength. In order to improve the strength, a sintered body containing alloy elements is heat-treated, namely, quenched and tempered, to manufacture products in general.

For example, in Japanese Examined Patent Application Publication No. 58-10962, an alloy steel powder containing a reduced amount of C, N, Si, Al, and O, at least one prealloyed element selected from a group consisting of Mn, Cr, Mo, and V, and the balance being unavoidable impurities and iron is proposed as a source powder for high strength parts manufactured by powder metallurgy, wherein the alloy steel powder has excellent compressibility, compactibility, and heat-treating properties.

Furthermore, in Japanese Unexamined Patent Application Publication No. 1-215904, partly alloyed steel powder is proposed to manufacture high strength automobile parts, wherein the alloy powder is prepared by diffusing and adhering Cu, Ni, and Mo powders to the surface of the steel powder simultaneously and has a small variation of dimensional change caused by heat treatment.

Furthermore, in order to reduce manufacturing cost, low-temperature sintering performed in a weak-oxidizing atmosphere at low temperature or the elimination of heat treatment after sintering have recently been required. A source powder for making sintered parts having high strength is also required, wherein the sintered parts are manufactured by performing low-temperature sintering or by a combination of performing low-temperature sintering and eliminating heat treatment after sintering.

When a prealloyed steel powder prepared by prealloying iron in a molten state with easily-oxidizable alloy elements such as Cr Mn and so on is sintered in a weak-oxidizing atmosphere, there is a problem in that a sintered body having a desired strength is not obtained because of the oxidation of the prealloyed alloy elements. When a partially alloyed steel powder prepared by partially alloying iron with alloy elements such as Ni, Mo, Cu and so on is used, the problem that alloy elements are oxidized does not arise but the following problem arises: the sintered body does not have a tensile strength of 800 MPa or more because of the insufficient diffusion of the alloy elements when low temperature sintering is performed, since high temperature sintering is necessary for the partially alloyed steel powder to diffuse alloy elements into an iron powder deeply and heat treatment is also necessary for the sintered body to have a high strength.

With regard to the above problem, for example, in PCT Japanese Translation Patent Publication No. 6-510331, an iron-based powder composition substantially consists of 0.5–4.5 mass % Ni, 0.65–2.25 mass % Mo, and 0.35–0.65 mass % C (balance being Fe)is proposed, wherein the iron-based powder composition is used for manufacturing a sintered body having a small variation dimensional change. In the iron-based powder composition, preferably the iron powder is diffusion-alloyed with Ni and/or Mo or prealloyed with Mo to obtain a high-strength sintered product having excellent dimensional stability after sintering.

In Japanese Unexamined Patent Application Publication No. 9-87794, a method for manufacturing a sintered iron alloy is proposed, wherein a mixed powder containing 1–2 mass % Cu, 1–3 mass % Ni, and 0.2–0.7 mass % C after sintering is prepared by mixing Cu, Ni and graphite powders into an alloy steel powder containing 3–5 mass % Ni, and 0.4–0.7 mass % Mo, and the balance being iron, the mixed powder is compacted, and the compact is sintered in a non-oxidizing atmosphere and then cooled at 5–20° C./min. in a sintering furnace.

In a method disclosed in PCT Japanese Translation Patent Publication No. 6-510331, there is a problem in that sufficient strength is not obtained, since a martensitic structure is not formed as a result of the low-temperature sintering. In another method disclosed in Japanese Unexamined Patent Application Publication No.9-87794, there is a problem in that sufficient strength is not obtained, since the density is low because the alloy steel powder has a low compressibility due to the high Ni content.

DISCLOSURE OF INVENTION

According to the above circumstances, it is an object of the present invention to provide an iron-based mixed powder used for manufacturing a high-strength sintered part having a tensile strength of 800 MPa or more, wherein the sintered component is only sintered at a low temperature, and is preferably only sintered at low temperature in a weak oxidizing atmosphere.

In order to achieve the above object, the inventors have diligently researched kinds and a alloying method of alloy elements. As a result, the following finding has been obtained: a sintered body having a martensitic structure including an austenitic phase in which Ni is partly concentrated can be obtained by performing only low-temperature sintering in a weak oxidizing atmosphere without further heat treatment when Ni, Mo, and Cu that are hardly oxidized during sintering are used as alloy elements increasing the strength and the contents of the elements are optimized, wherein Ni is added by both mixing the powders and by prealloying, Mo is added by prealloying, and Cu and graphite are added by mixing the powders. According to the above method, a high-strength sintered component having a tensile strength of 800 MPa or more can be manufactured.

The present invention has been completed according to the above finding and further studies.

The present invention provides an iron-based mixed powder used for high-strength sintered parts and, prepared by mixing an Ni powder, a Cu powder, and a graphite powder into an alloy steel powder, wherein the iron-based mixed powder contains 1–5 mass % of the Ni powder, 0.5–3 mass % of the Cu powder, 0.2–0.9 mass % of the graphite powder to the total of the alloy steel powder, the Ni powder, the Cu powder, and the graphite powder, wherein the alloy steel powder contains 0.5–3 mass % of prealloyed Ni, more than 0.7 to 4 mass % of prealloyed Mo, the balance being Fe and unavoidable impurities. In the iron-based mixed powder of the present invention, the alloy steel powder may contain 0.5–3 mass % of prealloyed Ni, more than 0.7 to 4 mass % of prealloyed Mo, 0.2–0.7 mass % of prealloyed Cu, and the balance being Fe and unavoidable impurities.

BEST MODE FOR CARRYING OUT THE INVENTION

In the present invention, Ni, Mo, and Cu are used as alloy elements for increasing the strength. These elements are not oxidized during sintering in a weak oxidizing atmosphere such as a generally-used low-cost RX gas (hydrocarbon conversion gas) atmosphere and the elements increase the strength effectively.

An iron-based mixed powder of the present invention is prepared by mixing an alloy steel powder with Ni, Cu, and graphite powders. In the present invention, Ni is added both by mixing powders and by prealloying in terms of the acceleration of sintering by the Ni powder, the formation of a retained austenite phase, and the martensitic transformation of the matrix. Mo is added by prealloying. Cu is added by mixing powders mainly in order to accelerate sintering by liquid-phase sintering of Cu, and may be additionally added by prealloying.

The alloy steel powder contains a prealloyed steel powder in which Ni and Mo or further Cu are used for prealloying. The prealloyed steel powder is prepared by water-atomizing molten steel having the predetermined composition of alloy elements. The water atomization is performed by using the usual apparatus according to a known method and is not specifically limited. After the water atomization, for the alloy steel powder, reduction treatment and pulverization are performed according to common methods.

The reason for limiting the composition of prealloyed steel powder will now be described.

Mo: More Than 0.7 to 4 Mass % Mo is a element for increasing the strength by solid solution strengthening and transformation strengthening and the decrease in the compressibility is a little when Mo is used for prealloying. When the Mo content is 0.7 mass % or less, the effect of sufficiently increasing the strength is not achieved. On the other hand, when the Mo content exceeds 4 mass %, the tensile-strength and the fatigue strength decrease due to remarkable a decrease in the compressibility caused by an increase in the hardness of an alloy steel particle. Thus, the Mo content is limited within the range of more than 0.7 to 4 mass %, and is preferably more than 1 to 3 mass %.

Ni: 0.5–3 Mass %

Ni shifts the starting temperature of bainitic or martensitic transformation to a lower value to form a fine structure, to strengthen the base matrix, and to increase the strength. When the Ni content is less than 0.5 mass %, the effect of sufficiently increasing the strength is not achieved. On the other hand, when the Ni content exceeds 3 mass %, the tensile strength and the fatigue strength decrease due to a remarkable decrease in the compressibility caused by an increase in the hardness of the alloy steel particle. Thus, the Ni content is limited within the range of 0.5–3 mass %, and is preferably 0.5–2 mass %.

Cu: 0.2–0.7 Mass %

In order to increase the strength of a sintered body, Cu may be contained according to the necessity. Cu is an element for increasing the strength and the tonghness by solid-solutioning in the iron matrix. When Cu coexists with Ni, the above effects are further promoted. When the Cu content is less than 0.2 mass %, the effect of sufficiently increasing the strength is not achieved. On the other hand, when the Cu content exceeds 0.7 mass %, the strength and the toughness decrease due to a decrease in the compressibility caused by an increase in the hardness of the alloy steel particle.

The alloy steel powder contains the above elements and the balance being Fe and unavoidable impurities. Allowable contents of the unavoidable impurities are 0.1 mass % or less of Si, 0.3 mass % or less of Mn, 0.02 mass % or less of S, and 0.02 mass % or less of P.

The reason for limiting the content of Ni, Cu, and graphite powders mixed into the alloy steel powder to form a mixed powder will now be explained. The content of each powder in the mixed powder is expressed as a mass percentage (mass %) to the total amount (total amount of the mixed powder) of the alloy steel, Ni, Cu, and graphite powders.

Ni powder: 1–5 Mass %

An Ni powder increase the strength by accelerating sintering and decreasing the size of the pores. Furthermore, an austenite phase in which Ni is concentrated after sintering is formed, and this increases the fatigue strength. When the Ni powder content is less than 1 mass %, sintering is not sufficiently accelated and the amount of the retained austenite phase is small. On the other hand, when the Ni powder content exceeds 5 mass %, the strength decreases due to the excessively large amount of the retained stenitie phase. Thus, the Ni powder content is limited within the range of 1–5 mass %, and is preferably 2–4 mass %. The Ni powder used may be a known one such as a nickel carbonyl powder produced by pyrolysis or a Ni powder produced by reducing nickel oxide.

Cu powder: 0.5–3 Mass %

A Cu powder is added to increase the tensile strength and the fatigue strength, by forming a liquid phase during sintering and accelerating sintering to make pores spherical. When the Cu powder content is less than 0.5 mass %, the effect of sufficiently increasing the strength is not achieved. When exceeding 3 mass %, the embrittlement arises. Thus, the Cu powder content is 0.5–3 mass %, and is preferably 0.5–3 mass %. The Cu powder used may be a known one such as electrolytic Cu powder or atomized Cu powder.

Graphite Powder: 0.2–0.9 Mass %

Graphite easily diffuses in an iron particle during sintering and promotes to increase the strength by solid-solutioning. When the graphite powder content is less than 0.2 mass %, the effect of sufficiently increasing the strength is not achieved. On the other hand, when exceeding 0.9 mass %, pre-eutectoid cementite is precipitated at a grain boundaries, and this reduces the strength. Thus, the graphite powder content is 0.2–0.9 mass %.

In the present invention, according to the necessity, 0.3–1 parts by weight of a lubricant may be added to 100 parts by weight of the mixed powder containing the alloy steel powder, the Ni powder, the Cu powder, and the graphite powder. The lubricant is a known one such as zinc stearate or oleic acid that reduces the friction between the powders each other or between the powders and a die during compacting.

The lubricant is mixed with the alloy steel powder, the Ni powder, the Cu powder, and the graphite powder, and the resulting mixture may be heated and cooled to adhere Ni, Cu, graphite particles to an alloy steel particle by using the lubricant as a binder. According to this method, segregation of Ni, Cu, and graphite powders is prevented. Furthermore, powdery lubricants may be used.

In the present invention, the alloy steel powder is mixed with the Ni powder and the Cu powder, and the resulting mixture may be heated to form partly alloyed steel powder. According to this method, segregation of Ni powder and Cu powder is prevented.

When the iron-based mixed powder of the present invention is heat-treated for a low temperature-sintering in an RX gas atmosphere having weak oxidation at 1100 to 1200° C., the resulting as-sintered body has a strength of 800 Mpa or more, that is, a high strength. However, the- present invention is not limited to this method and sintering may be performed in, for example, an $N_2$ or AX gas atmosphere at a higher temperature of 1200° C. or more, in order to further increase the strength.

EXAMPLES

Alloy steels containing prealloyed Mo, Ni, and Cu and having compositions shown in Table 1 were melted to prepare prealloyed steel powders by the water-atomizing method.

Ni, Cu, and graphite powders were mixed into the prealloyed steel powder so as to form compositions (expressed as mass % to the mass of the mixed powder) shown in Table 1, and 0.8 part by weight of zinc stearate was further added to 100 parts by weight of the mixed powder consisting of the alloy steel powder, the Ni powder, the Cu powder and the graphite powder. The resulting mixture was then agitated with a blender.

An alloy steel powder (mixed powder No. 37) prepared by using Cr, Mo, and V for prealloying and another alloy steel powder (mixed powder No. 38) prepared by using Ni, Mo, and Cu for partially-alloying were used as conventional examples, wherein both the alloy steel powders further contain a graphite powder.

The resulting mixed powders were compacted with a compacting pressure of 490 MPa to form compacts each having a shape of a test piece for a tensile test, according to method M 04-1992 of Japan Powder Metallurgy Association (JAMA). For the resulting compacts, low temperature sintering was performed in an RX gas atmosphere at 1130° C. for 20 minutes to prepare sintered bodies.

For the resulting sintered bodies, measurement of densities and a tensile test were performed. The tensile test was performed at a tensile rate of 5 mm/min. to measure the tensile strength.

Furthermore, the resulting mixed powders were compacted with a compacting pressure of 490 MPa to form compacts each having a dimension of 15×15×80 mm. The resulting compacts were sintered under the same conditions as the above. The resulting sintered bodies were machined into rod-shaped fatigue pieces each having a diameter of 8 mm at the parallel portion, and a rotating bending fatigue test was performed. The fatigue limit in the $10^7$th cycle was defined as the rotating bending fatigue strength.

The test results are shown in Table 1.

From Table 1, it is clear that samples of the examples according to the present invention exhibit a density of 6.97 $Mg/m^3$ or more, a tensile strength of 800 Mpa or more, and a fatigue strength of 240 Mpa or more, that is, the sintered bodies have high strength. Samples of the comparative examples outside the scope of the present invention have a tensile strength of less than 800 MPa and a fatigue strength of less than 240 MPa.

In mixed powders No. 1, 7, 14, and 21, since the Mo and Ni contents in alloy steel powders, the amount of Ni powder, and the amount of Cu powder are small, respectively,effects of increasing the strength are slight and high strengths are not achieved.

In mixed powders No. 6 and 13, since the Mo and Ni contents are excessively large, respectively, the density of green compacts decreases sharply due to the high hardness of alloy steel particles so that the high tensile strength and the high fatigue strength are not obtained.

In mixed powder No. 20, since an amount of Ni powder is excessively large, a large quantity of retained austenite phases is formed so that the high strength is not obtained.

In mixed powder No. 27, since an amount of Cu powder is excessively large, the sintered body is brittle so that the high strength is not obtained.

In mixed powder No. 37 containing an alloy steel powder prepared by using Cr, Mo, and V for prealloying, since Cr and V are oxidized during sintering in a weak oxidizing atmosphere, the high strength is not obtained.

In mixed powder No. 38 containing an alloy steel powder prepared by using Mo, Ni, and Cu for partly-alloying, since sintering is performed at a low temperature and the heat treatment is not subsequently performed, martensitic structures are not formed due to the insufficient diffusion of alloy elements so that the high strength is not obtained.

TABLE 1

| | Composition of Mixed Powder | | | | | | | | Sintered Body | | | |
|---|---|---|---|---|---|---|---|---|---|---|---|---|
| No. of Mixed | Composition of Alloy Steel Powder (mass %)* | | | | Powder Content (mass %)** | | | | Density | Tensile Strength | Rotating Bending Fatigue Strength | |
| Powder | Mo | Ni | Cu | Others | Ni | Cu | Graphite | Others | $Mg/m^3$ | MPa | MPa | Remarks |
| 1 | 0.0 | 0.6 | — | — | 4.0 | 2.0 | 0.4 | — | 7.13 | 730 | 235 | Comparative Example |
| 2 | 0.8 | 0.6 | — | — | 4.0 | 2.0 | 0.4 | — | 7.12 | 865 | 280 | Example |
| 3 | 1.0 | 0.6 | — | — | 4.0 | 2.0 | 0.4 | — | 7.11 | 910 | 290 | Example |
| 4 | 2.6 | 0.6 | — | — | 4.0 | 2.0 | 0.4 | — | 7.09 | 870 | 280 | Example |
| 5 | 3.5 | 0.6 | — | — | 4.0 | 2.0 | 0.4 | — | 7.06 | 820 | 265 | Example |
| 6 | 4.5 | 0.6 | — | — | 4.0 | 2.0 | 0.4 | — | 6.99 | 730 | 235 | Comparative Example |
| 7 | 0.8 | — | — | — | 3.0 | 1.5 | 0.5 | — | 7.13 | 730 | 220 | Comparative Example |
| 8 | 0.8 | 0.6 | — | — | 3.0 | 1.5 | 0.5 | — | 7.12 | 865 | 265 | Example |
| 9 | 0.8 | 1.0 | — | — | 3.0 | 1.5 | 0.5 | — | 7.11 | 940 | 285 | Example |
| 10 | 0.8 | 1.5 | — | — | 3.0 | 1.5 | 0.5 | — | 7.10 | 945 | 290 | Example |
| 11 | 0.8 | 2.2 | — | — | 3.0 | 1.5 | 0.5 | — | 7.08 | 920 | 280 | Example |
| 12 | 0.8 | 2.9 | — | — | 3.0 | 1.5 | 0.5 | — | 7.03 | 875 | 265 | Example |
| 13 | 0.8 | 3.5 | — | — | 3.0 | 1.5 | 0.5 | — | 6.95 | 760 | 230 | Comparative Example |
| 14 | 1.0 | 2.0 | — | — | — | 1.0 | 0.4 | — | 6.96 | 760 | 190 | Comparative Example |
| 15 | 1.0 | 2.0 | — | — | 1.0 | 1.0 | 0.4 | — | 7.01 | 890 | 240 | Example |
| 16 | 1.0 | 2.0 | — | — | 2.0 | 1.0 | 0.4 | — | 7.03 | 955 | 275 | Example |

TABLE 1-continued

| No. of Mixed Powder | Composition of Mixed Powder: Composition of Alloy Steel Powder (mass %)* | | | | Composition of Mixed Powder: Powder Content (mass %)** | | | | Sintered Body | | | |
|---|---|---|---|---|---|---|---|---|---|---|---|---|
| | Mo | Ni | Cu | Others | Ni | Cu | Graphite | Others | Density Mg/m$^3$ | Tensile Strength MPa | Rotating Bending Fatigue Strength MPa | Remarks |
| 17 | 1.0 | 2.0 | — | — | 3.0 | 1.0 | 0.4 | — | 7.06 | 980 | 300 | Example |
| 18 | 1.0 | 2.0 | — | — | 4.0 | 1.0 | 0.4 | — | 7.08 | 960 | 310 | Example |
| 19 | 1.0 | 2.0 | — | — | 5.0 | 1.0 | 0.4 | — | 7.11 | 900 | 305 | Example |
| 20 | 1.0 | 2.0 | — | — | 6.0 | 1.0 | 0.4 | — | 7.13 | 780 | 230 | Comparative Example |
| 21 | 1.2 | 1.5 | — | — | 3.0 | — | 0.6 | — | 7.13 | 730 | 220 | Comparative Example |
| 22 | 1.2 | 1.5 | — | — | 3.0 | 0.5 | 0.6 | — | 7.11 | 880 | 270 | Example |
| 23 | 1.2 | 1.5 | — | — | 3.0 | 1.0 | 0.6 | — | 7.09 | 910 | 280 | Example |
| 24 | 1.2 | 1.5 | — | — | 3.0 | 1.5 | 0.6 | — | 7.07 | 925 | 280 | Example |
| 25 | 1.2 | 1.5 | — | — | 3.0 | 2.5 | 0.6 | — | 7.04 | 850 | 260 | Example |
| 26 | 1.2 | 1.5 | — | — | 3.0 | 3.0 | 0.6 | — | 7.02 | 800 | 240 | Example |
| 27 | 1.2 | 1.5 | — | — | 3.0 | 3.5 | 0.6 | — | 7.02 | 690 | 210 | Comparative Example |
| 28 | 1.0 | 0.6 | — | — | 4.0 | 1.5 | 0.1 | — | 7.05 | 730 | 230 | Comparative Example |
| 29 | 1.0 | 0.6 | — | — | 4.0 | 1.5 | 0.3 | — | 7.09 | 880 | 285 | Example |
| 30 | 1.0 | 0.6 | — | — | 4.0 | 1.5 | 0.5 | — | 7.12 | 920 | 300 | Example |
| 31 | 1.0 | 0.6 | — | — | 4.0 | 1.5 | 0.8 | — | 7.10 | 830 | 270 | Example |
| 32 | 1.0 | 0.6 | — | — | 4.0 | 1.5 | 1.0 | — | 7.05 | 720 | 230 | Comparative Example |
| 33 | 1.0 | 2.0 | 0.2 | — | 3.0 | 0.5 | 0.4 | — | 7.04 | 950 | 290 | Example |
| 34 | 1.0 | 2.0 | 0.4 | — | 3.0 | 0.5 | 0.4 | — | 7.01 | 955 | 290 | Example |
| 35 | 1.0 | 2.0 | 0.6 | — | 3.0 | 0.5 | 0.4 | — | 6.97 | 910 | 260 | Example |
| 36 | 1.0 | 2.0 | 0.8 | — | 3.0 | 0.5 | 0.4 | — | 6.91 | 780 | 200 | Comparative Example |
| 37 | 0.3 | — | — | Cr:3.0, V:0.3 | — | — | 0.8 | — | 6.90 | 461 | 150 | Conventional Example |
| 38 | — | — | — | Ni:5.02, Cu:1.8, Mo:0.38** | | | 0.6 | — | 7.12 | 620 | 220 | Conventional Example |

*Mass % to the total amount of a mixed powder
**Ni, Cu, and Mo were partially alloyed.

Industrial Applicability

According to the present invention, sintering is performed at a low temperature in a weak oxidizing atmosphere and sintered bodies having high strength are manufactured without performing heat treatment after the sintering, so that the sintered bodies are provided at low cost, and the method has an industrially important effect.

What is claimed is:

1. An iron-based mixed powder used for a high-strength sintered part and prepared by mixing an Ni powder, a Cu powder, and a graphite powder into an alloy steel powder, comprising 1–5 mass % of the Ni powder, 0.5–3 mass % of the Cu powder, 0.2–0.9 mass % of the graphite powder to the total of the alloy steel powder, the Ni powder, the Cu powder, and the graphite powder, wherein the alloy steel powder contains 0.5–3 mass % of prealloyed Ni, more than 0.7 to 4 mass % of prealloyed Mo, and the balance being Fe and unavoidable impurities.

2. The iron-based mixed powder used for a high-strength sintered part according to claim 1, wherein the alloy steel powder contains 0.5–3 mass % of prealloyed Ni, more than 0.7 to 4 mass % of prealloyed Mo, 0.2–0.7 mass % of prealloyed Cu, and the balance being Fe and unavoidable impurities.

3. The iron-based mixed powder used for a high-strength sintered part according to claim 1, wherein the tensile strength after sintering is 800 MPa or more and the density after sintering is 6.97 Mg/m$^3$ or more.

4. The iron-based mixed powder used for a high-strength sintered part according to claim 3, wherein the sintering is a low-temperature sintering heat treatment performed at 1100–1200° C.

5. The iron-based mixed powder used for a high-strength sintered part according to claim 2, wherein the tensile strength after sintering is 800 MPa or more and the density after sintering is 6.97 Mg/m$^3$ or more.

* * * * *

UNITED STATES PATENT AND TRADEMARK OFFICE

CERTIFICATE OF CORRECTION

PATENT NO. : 6,652,618 B1
DATED : November 25, 2003
INVENTOR(S) : Unami et al.

It is certified that error appears in the above-identified patent and that said Letters Patent is hereby corrected as shown below:

Title page,
Item [54], Title, delete the title in its entirety and replace it with the following:
-- IRON-BASED MIXED POWDER FOR HIGH STRENGTH SINTERED PARTS --;

Column 5,
Table 1, Heading (Powder Content); delete "*" (second occurrence);

Column 7,
Table 1, Heading (Powder Content); delete "*" (second occurrence).

Signed and Sealed this

Twenty-eighth Day of June, 2005

JON W. DUDAS
*Director of the United States Patent and Trademark Office*